US006453584B1

(12) United States Patent
Buckner

(10) Patent No.: US 6,453,584 B1
(45) Date of Patent: Sep. 24, 2002

(54) CONTINUOUS VACUUM, SEPARATOR, DISPENSING SYSTEM

(76) Inventor: Lynn Allen Buckner, P.O. Box 609, Chickamauga, GA (US) 30707

( * ) Notice: Subject to any disclaimer, the term of this patent is extended or adjusted under 35 U.S.C. 154(b) by 0 days.

(21) Appl. No.: 09/722,797

(22) Filed: Nov. 27, 2000

(51) Int. Cl.[7] ..... E02F 3/88; C09K 3/00; E21B 3/18; E21B 21/06; E21B 43/114

(52) U.S. Cl. ..... 37/323; 175/66; 175/67; 220/212

(58) Field of Search ..... 37/323, 330, 331; 175/67, 66, 42, 324; 220/212, 231

(56) References Cited

U.S. PATENT DOCUMENTS 4,019,649 A * 4/1977 Simon ..... 220/88 B
6,209,568 B1 * 4/2001 Guarneri ..... 137/209

* cited by examiner

*Primary Examiner*—Christopher J. Novosad

(57) ABSTRACT

A vacuum boring and mud recovery system comprising a vacuum container, a vacuum producing device to create a vacuum within said container, a conduit to vacuum solid particles and liquids into the vacuum container and a dispensing device to dispense the liquid or solid particles from the vacuum container without eliminating the vacuum environment within the vacuum container. Vacuum container contents are stored within the container while simultaneously dispensing the solid particles and or liquids. The vacuum container system may also have a separating device disposed within it to separate solids and liquids by category. The vacuum container system is a continuous operation vacuum container which can simultaneously fill, store and dispense solid particles and liquids with the added ability to simultaneously separate the solids and liquids before they are dispensed from the vacuum container. This is accomplished without eliminating the vacuum environment within the vacuum container.

12 Claims, 8 Drawing Sheets

CONTINUOUS VACUUM, SEPARATOR, DISPENSING SYSTEM

BACKGROUND OF THE INVENTION

1. Field of the Invention

The present invention relates to a vacuum boring and mud recovery system comprising a device which will create a vacuum condition within a container, a conduit to transport a liquid and solid particles into the vacuum container, a dispensing device to dispense a liquid or a solid from the vacuum container without eliminating the vacuum environment within the vacuum container, and said vacuum container having the ability to fill, store and dispense its contents simultaneously. Said vacuum container further comprises a means to separate a liquid from solid particles.

2. Description of the Related Art

Current state of the art vacuum boring and mud recovery systems have a vacuum container having the ability to be filled and store liquid and solid particles. After filling said vacuum container to a predetermined capacity, the vacuum producing device must be discontinued, the filling must discontinue, the vacuum environment within the vacuum container is eliminated, the container opened and the contents dumped out. After the container is emptied, the vacuum producing device may be restarted and the filling and storing may restart. Currently, vacuum containers capable of vacuuming mud and boring earth are operated as a batch process.

The primary objective of the present invention is to provide a vacuum container having a vacuum capable of boring and mud recovery and provide simultaneously, vacuum fill, store and dispense. It is yet another objective of the invention to provide a means of separating the stored contents by predetermined category and dispensing them without stopping the vacuum fill and store operation or eliminating the vacuum environment within the vacuum container.

SUMMARY OF THE INVENTION

The above described objectives and others are met by a vacuum container equipped with a vacuum producing device, a filling conduit and a dispensing device having the means to dispense a liquid or solid particles from the vacuum container without eliminating the vacuum environment within the vacuum container.

A separating device may be added within the vacuum container which has the ability to separate the liquid and solid particles by predetermined category. The separating device can include a filter, a stationary screen, a vibrating screen, a centrifuge, a hydrocyclone or a combination thereof.

At least one or more dispensing devices may be attached to the vacuum container.

The dispensing device may utilize a dual valve technique, a dual piston technique, a rotary void technique, other techniques or a combination thereof to create the void filling and dispensing device. The dispensing void utilized to remove the solids and or liquids from the vacuum tank, without substantially depleting the vacuum environment within the vacuum tank, can include a progressive cavity pump, a diaphragm pump, a gear pump, a grinder, a vane axial pump and check valve.

DESCRIPTION OF THE PREFERRED EMBODIMENT

Figure 1:
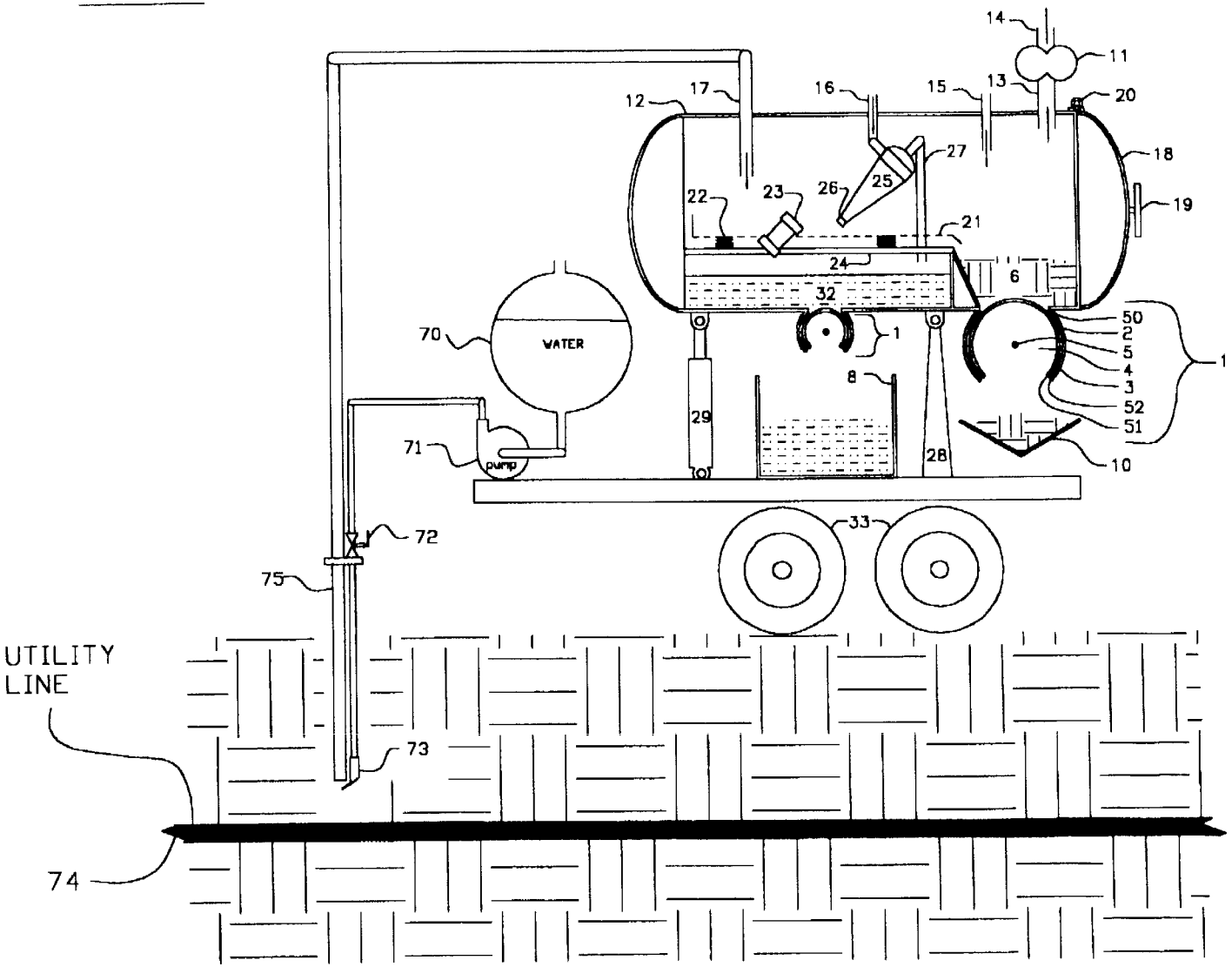
FIG. 1 is a side elevation of a vacuum boring unit being used to locate a utility line. The unit shows a pressure water system, a vacuum boring assembly and vacuum container complete with vibrating screen, hydrocyclone and dispensers.

The above described needs are met by a vacuum container 12, equipped with a vacuum producing device 11, which extracts gases from container 12, through a conduit 13, and dispenses said gas to atmosphere through a conduit 14.

Liquid 32, or solid particles 6 vacuumed through conduit 15 will be stored in container 12, above the void dispensing device 1, 7 or 60, 101, 103, 105, 107 until they are dispensed on demand by device 1, 7 or 60. Solid particles 6, or mud 32, which are dispensed by device 1, 7 or 60, may be dispensed onto a conveyor 10. The dispensed material 6 can be transported to a predetermined destination.

Container door 18 gives access to the inside of container 12. Container door 18, is hinged 20 and secured 19.

Liquid and solid particles vacuumed through conduit 17 fall onto a screen 21 which may be fixed or it may be mounted on springs 22 attached to a support 24 and vibrated by a vibrating device 23. Screen 21 may have an orifice opening size of choice and a location and mounting angle of choice. Screen 21 will separate vacuumed liquid and solid particles allowing mud 32 small enough to pass through the screen 21 orifice to be collected separate from material 6 which will not pass through the screen 21. Liquid and solid particles 32, which pass through the screen 21 may be dispensed on demand by the void dispensing device 1, 7 or 60, 101, 103, 105, 107 into a holding container 8. Dispensed material 32 may be transported by a predetermined method to a predetermined destination.

Liquid or solid particles vacuumed through conduit 16 then enter a hydrocyclone 25. Larger, heavier material exit the hydrocyclone 25 through orifice 26. Lighter, smaller material exit through conduit 27.

Container 12 may be supported by a stand 28 and or a hydraulic cylinder 29.

Container 12 may be mounted on a trailer or powered mobile device 30 and 33.

Figure 2:
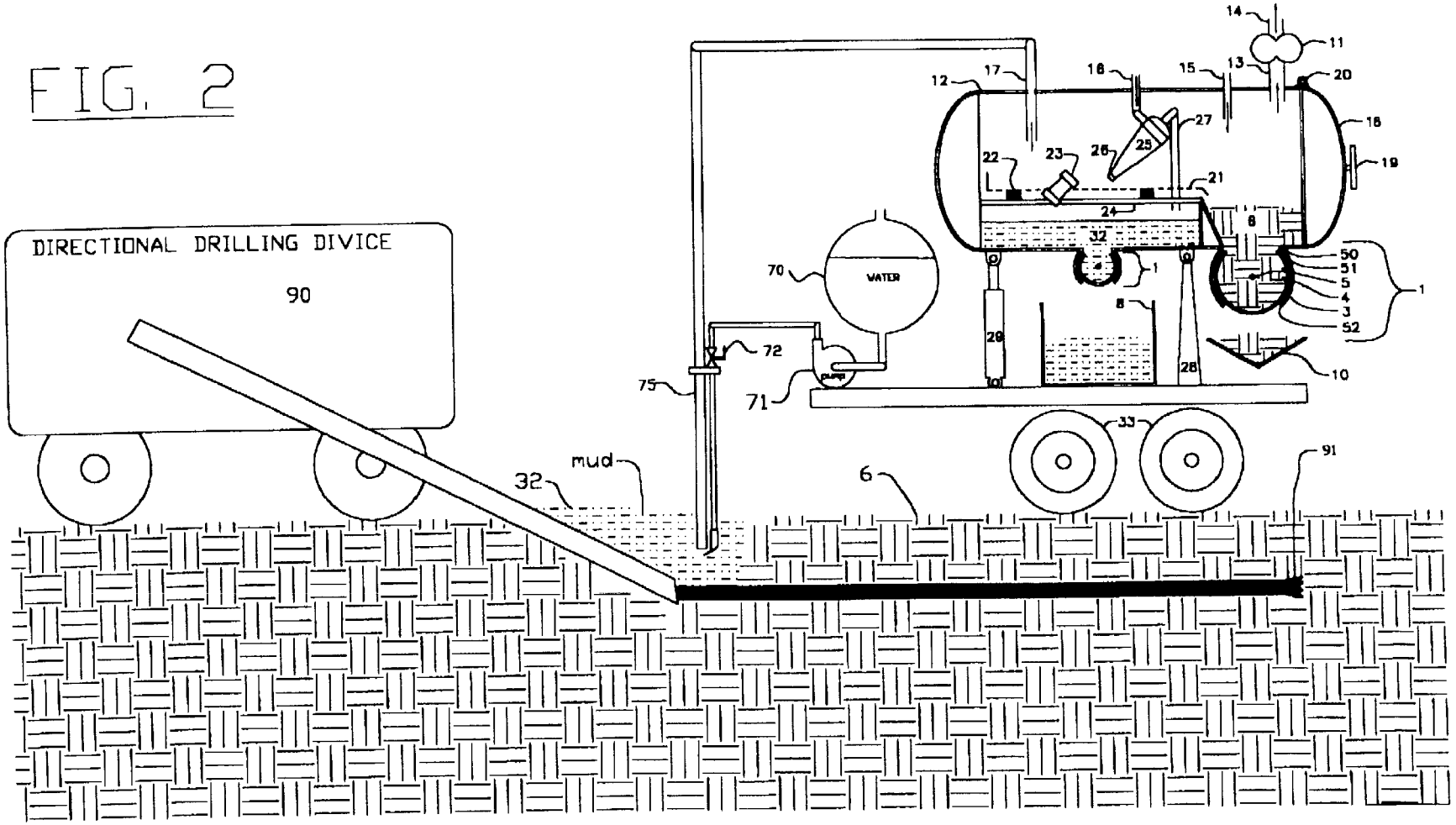
FIG. 2 is a side elevation as shown in FIG. 1 except the vacuum boring unit is shown recovering and recycling lubrication mud used by directional drilling devices.
Figure 3:
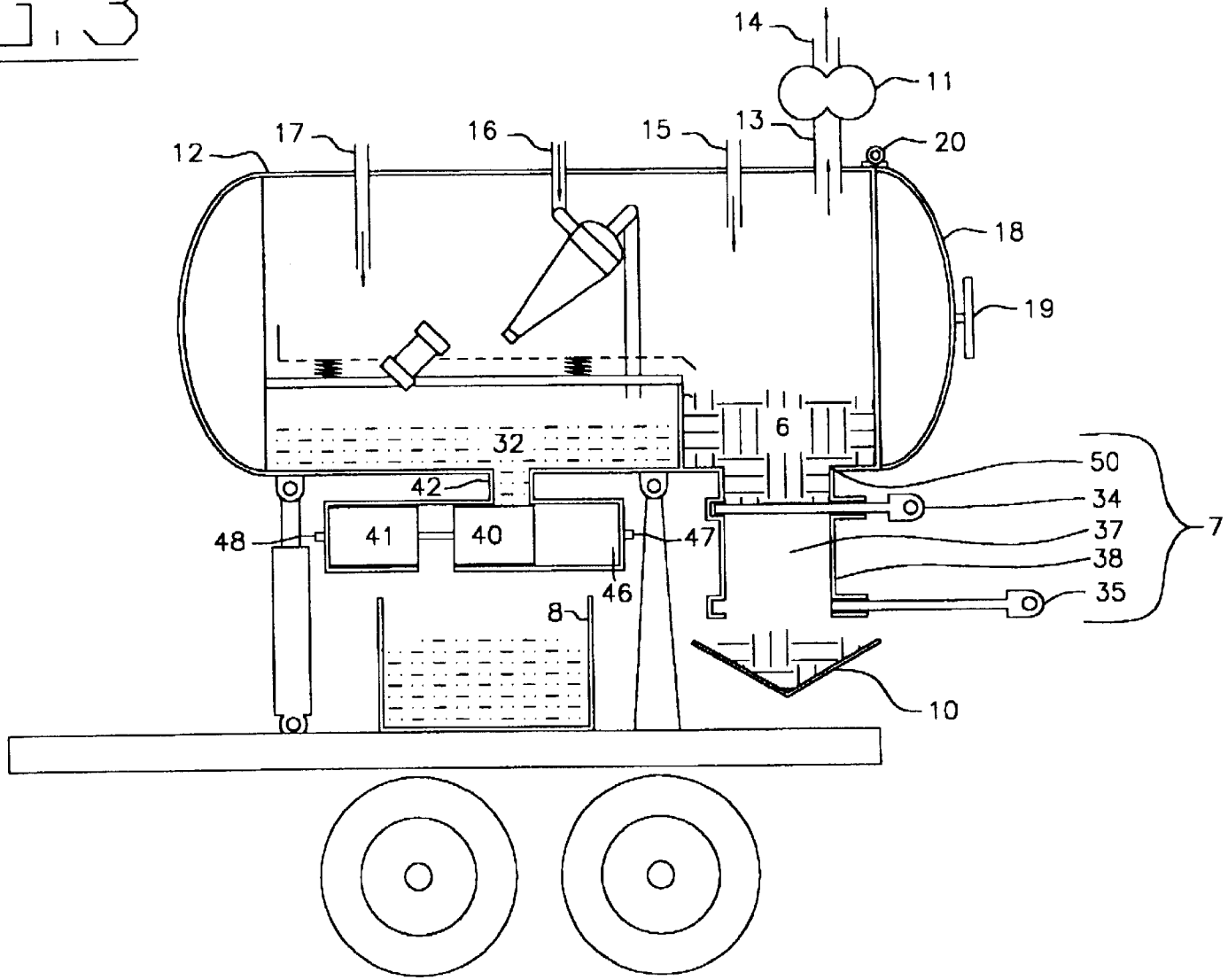
FIG. 3 is a side elevation view of a vacuum boring unit showing a vacuum container mounted onto a mobile unit. The vacuum container shows a vibrating screen and hydrocyclone as methods of separating the liquid and solid material. A dual valve technique dispenser is shown in the dispense configuration and a dual piston technique dispenser is shown in the dispense configuration.

Dispensing device 1 is an example of a rotary void technique consisting of a stationary outer support frame 2 with dispensing orifice 52, inner rotating shell 3 closely sealed to the stationary outer support frame 2. The inner rotating shell 3 provides an inner void 4, which can be filled or emptied through orifice 51, which rotates on a center shaft 5. When the inner shell 3 has its void 4 in communication with the vacuum container 12 dispensing orifice 50 by means of orifice 51, as shown in FIG. 2, the atmosphere in the void 4 equalizes with the internal environment of vacuum container 12. The material 6 enters the void 4 by gravity. Inner shell 3 then rotates on support shaft 5, 180 degrees. FIG. 1, shows the inner shell 3 with the void in communication with the external atmosphere by means of orifice 51 being in communication with orifice 52. The void 4 equalizes pressure with the external atmosphere allowing the void 4 material to dispense by gravity onto conveyor 10 below. Repeating this method allows for dispensing of material 6 or 32 from vacuum container 12.

Figure 4:
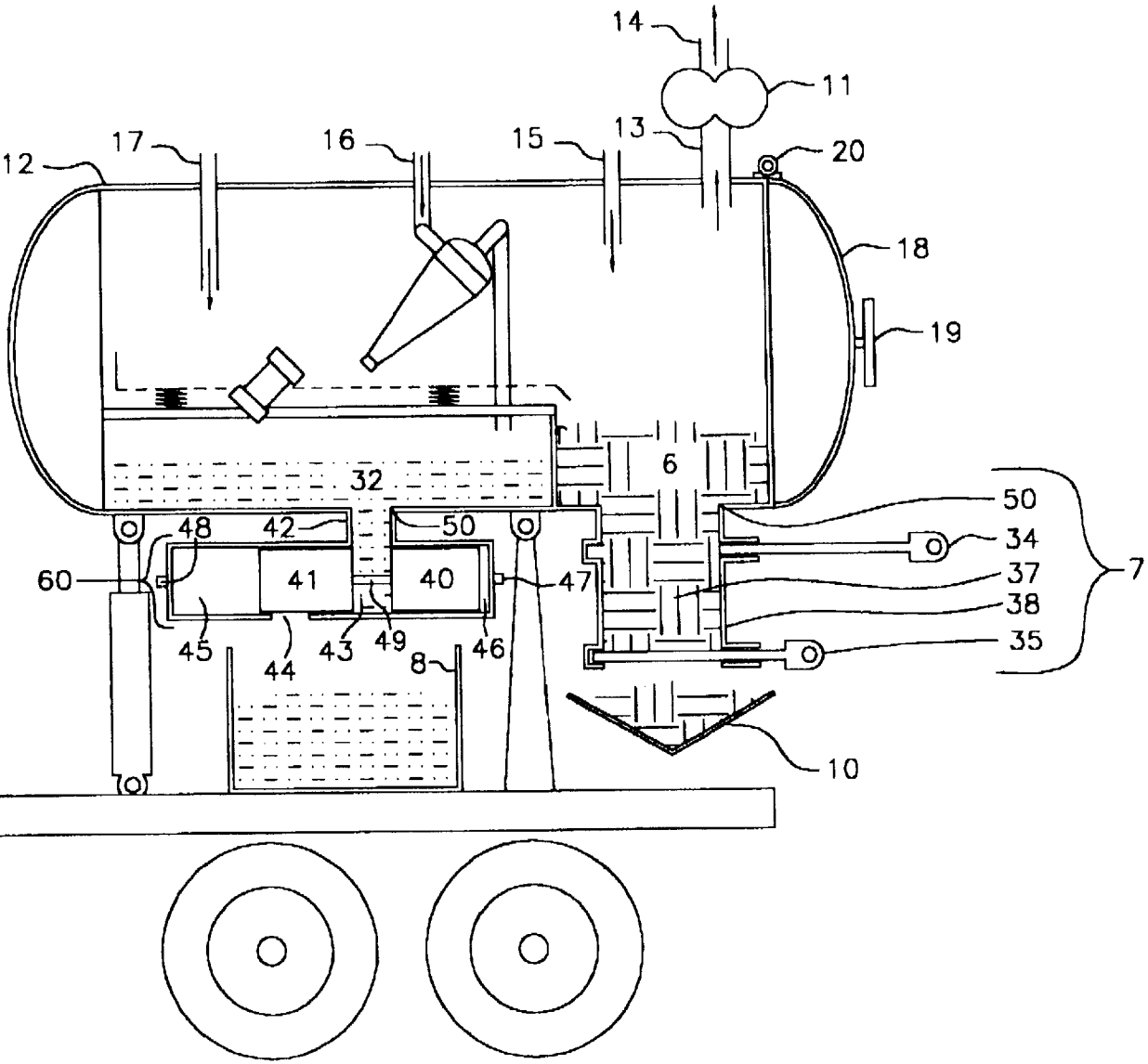
FIG. 4 is the same as FIG. 3 except the dual valve void dispenser is shown in the fill configuration and the dual piston void dispenser is shown in the fill configuration.
Figure 5:
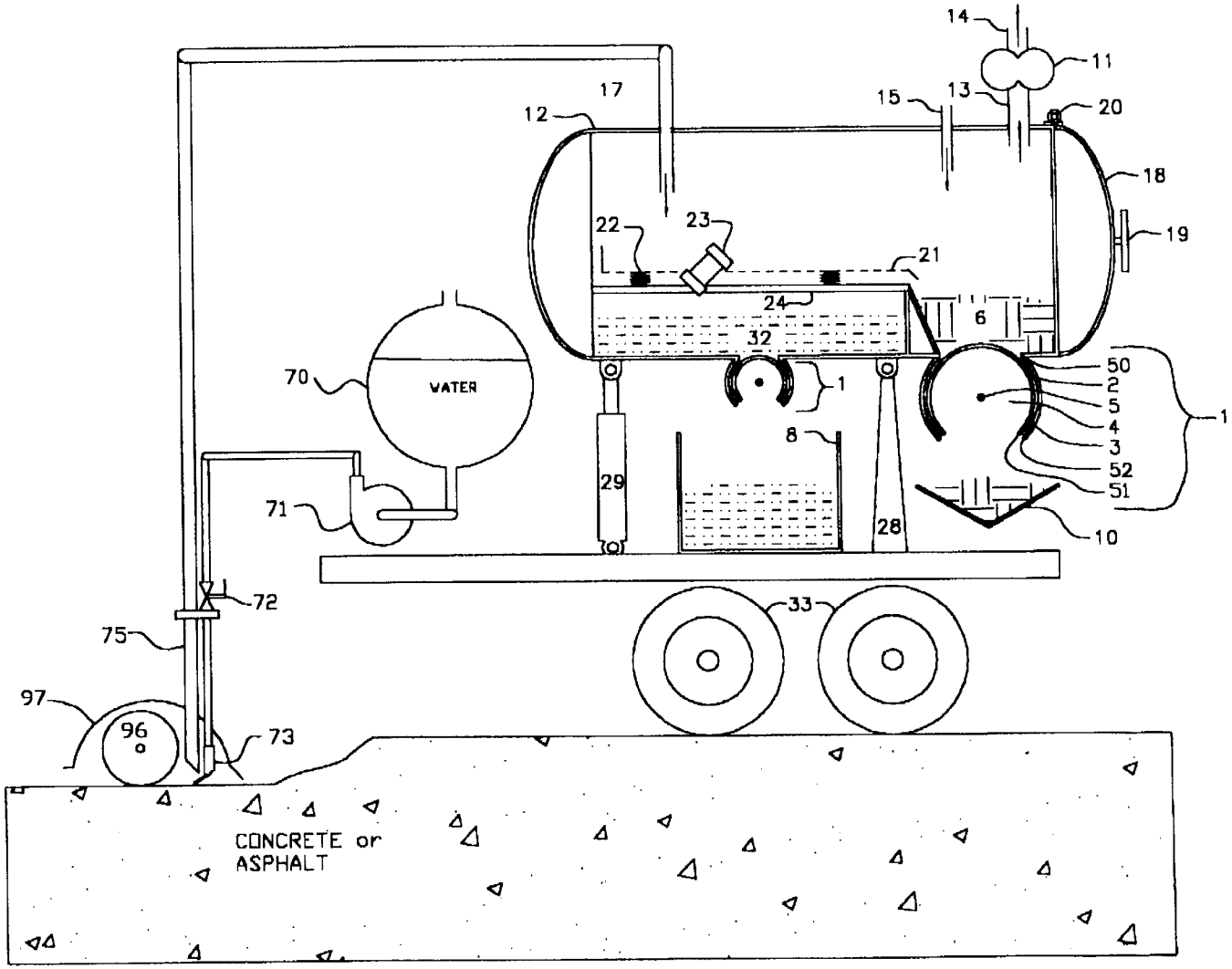
FIG. 5 is a side elevation view of a vacuum container mounted onto a mobile unit. The vacuum container shows a vibrating screen as a method to separate liquids and solids. Two dispenser units are shown in the dispense configuration.
Figure 6:
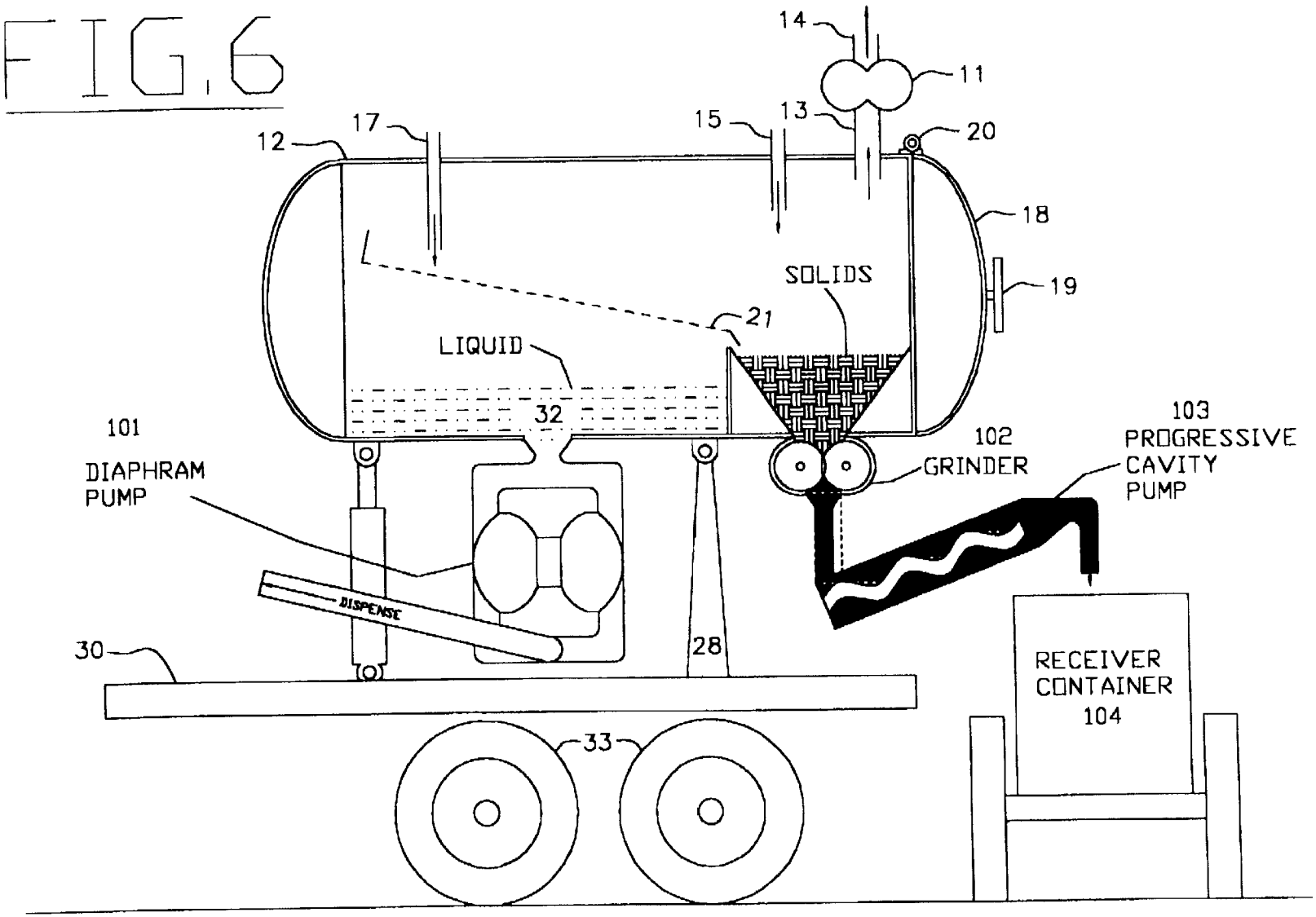
FIG. 6 A vacuum unit showing a vacuum container with a screen disposed within it to separate liquids from solids. A diaphragm pump is used to dispense the liquid and a progressive cavity pump is used to dispense the solids while simultaneously operating the vacuum process.
Figure 7:
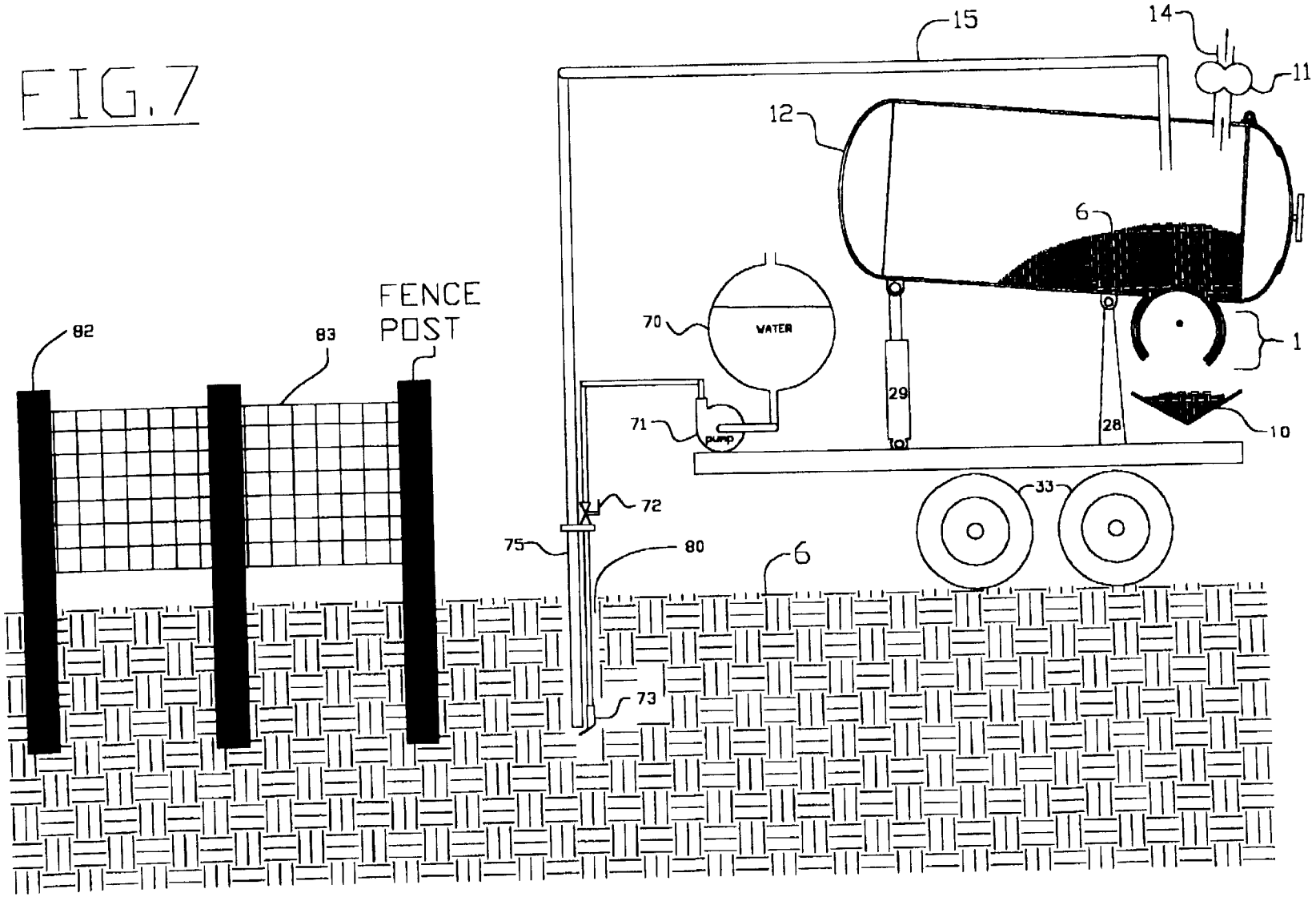
FIG. 7 is a vacuum boring unit mounted onto a mobile platform with a pressure water system and vacuum container equipped with one dispensing unit in the dispensing configuration. No separation equipment is shown. The vacuum boring unit is being used to bore holes for fence posts.
Figure 8:
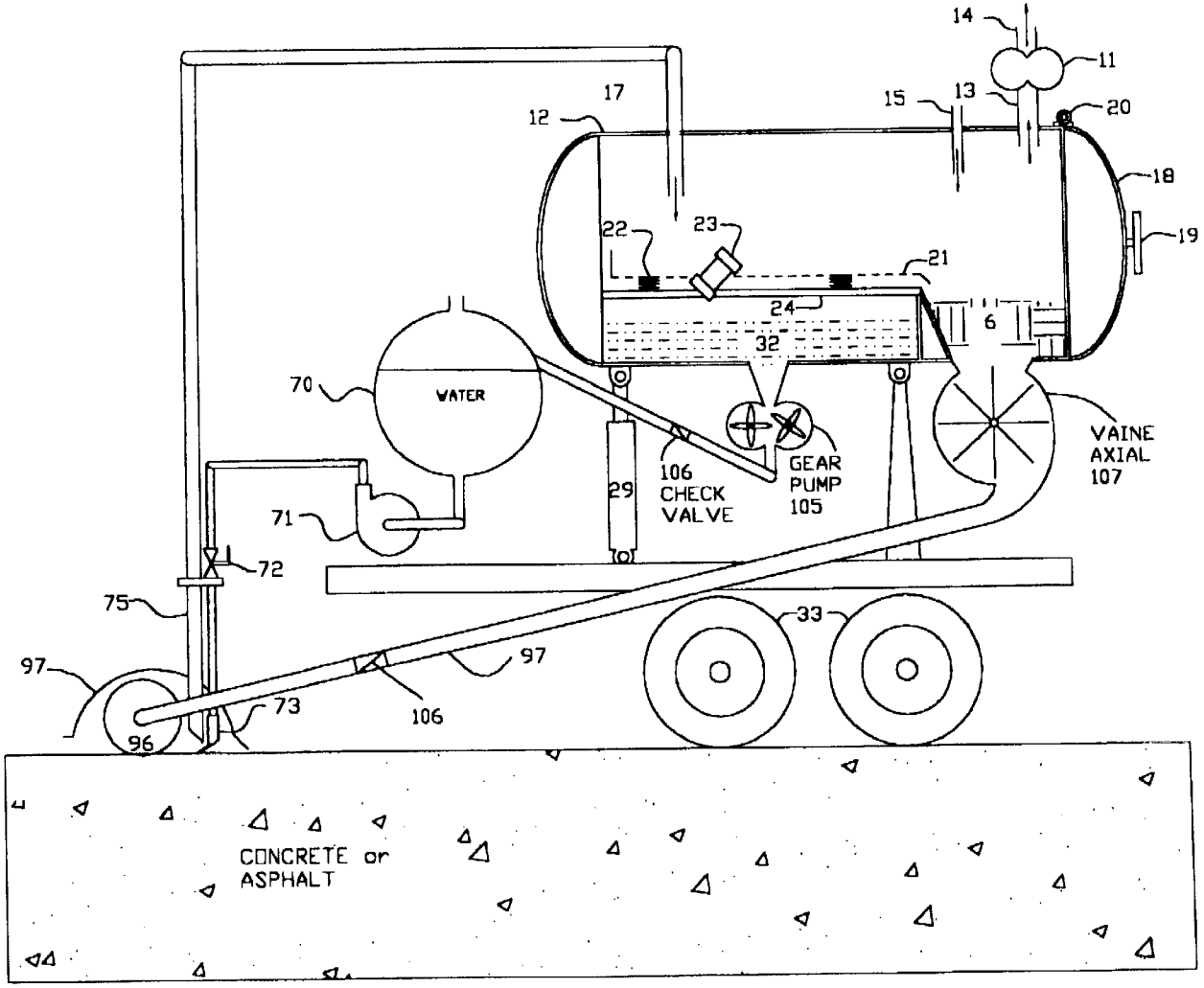
FIG. 8 is a vacuum unit mounted onto a mobile platform along with a high pressure water system and rotary brush. The vacuum container is equipped with a gear pump and check valve to dispense the liquid and uses a vane axial pump with check valve to dispense the solids. The vacuum unit is equipped with a filter screen system disposed within the vacuum tank to separate solids from liquids. Solids may be returned to the brush for reuse. The water may be returned to the water tank for reuse.

Dispensing device 7 is an example of a dual valve technique consisting of a stationary outer shell 38 mounted in communication with the dispensing orifice 50 of vacuum container 12. This configuration allows the void 37 of the dispensing device 7 to be in communication with orifice 50. When valve 34 is in the open position and valve 35 is in the closed position, as shown in FIG. 4, it allows the liquid and or solid particles from within vacuum container 12 to flow by gravity through orifice 50 into void 37. By first closing valve 34 and then opening valve 35, the void 37 will equalize pressure with the outside atmosphere and thus dispense by gravity the void 37 contents 6. A conveyor 10 can be placed under dispensing device 7 to collect the contents 6 which are dispensed and transport them to a predetermined location such as a dump truck.

Dispensing device 60, as shown in FIG. 4, is an example of a dual piston technique consisting of a fixed outer shell 42 which is placed in communication with the vacuum container 12 dispensing orifice 50. The fixed outer shell 42 is also equipped with a dispensing outlet orifice 44. In a first position, the void 43 of the dispensing device 60 is in communication with the vacuum container 12 dispensing orifice 50. In this first position, void 43 equalizes pressure with the vacuum container 12 thus allowing the contents 32 to move into void 43. air or liquid pressure is applied through conduit 47 into cavity 46 and venting pressure from cavity 45 through conduit 48, the void 43 will be moved from the first position to the second position placing the void 43 in communication with the outer shell dispensing orifice 44. Void 43 equalizes pressure with the outside atmosphere and dispenses its contents 32. Repeating the first and second positions, the contents 32 of vacuum container 12 are dispensed. Contents 32 dispensed from device 60 can be collected in container 8 and stored until they are transported at a predetermined time to a predetermined location by any transport device such as a pump.

The container 12 contents 6 and or 32 may enter through the conduit 15, 16 or 17. Said conduits are attached to a vacuum boring assembly 75 placed in close communication with the water jet nozzle 73 which aids in boring the earthen hole. Valve 72 allows the water supply to be stopped or started as required by the boring conditions. Pressure water pump 71 supplies water to nozzle 73. Water storage tank 70 supplies water for the pump 71.

The vacuum assembly 75 has multiple uses such as but not limited to: boring through the earth in order to locate utility lines 74 without threat of causing mechanical damage and recovery of lubricating mud 32 used by directional drilling devices 90. The mud 32 lubricates the directional drilling shaft and head 91. Also, the vacuum boring assembly has the ability to bore holes for fence posts 82 on which fencing may be attached. The vacuum assembly 75 may be used to vacuum any loosened debris. Ultra high pressure water can be supplied to nozzle 73 to even reduce concrete and asphalt to a liquid and solid slurry which can be vacuumed by assembly 75.A combination of high pressure liquid and high pressure gas may be used to loosen items to be vacuumed. A rotary cutting devise or rotary brush 96 may be added to the assembly to aid in loosening items to be vacuumed. A shield 97 may be added to cover the nozzle 73 cutting devise or brush 96. A transport conduit 97 may convey solids from the vane axial pump 107 to the brush 96 thus reusing the solids 6 for such activities as cleaning & removing petroleum products from parking surfaces. Liquids 32 may be reused, by transporting it from the vacuum tank 12 to the liquid storage tank 70 by means of a gear pump 105 and a check valve 106. A diaphragm pump 101 may be used to dispense liquid 32 from the vacuum tank 12. A grinder 102 may be utilized within the vacuum tank 12 to reduce solid 6 particle size before a progressive cavity pump 103 dispenses the solids 6 in to a receiver container 104.

What is claimed is:

1. A vacuum container comprising:

a vacuum producing device attached to create a vacuum within said vacuum container, a conduit to vacuum liquid and solid particles into the vacuum container, a means to allow a gas to be emitted through said vacuum producing device while leaving said liquid and solid particles stored within said vacuum container and a dispensing device to dispense said liquid and solid particles from said vacuum container without eliminating the vacuum atmosphere within said vacuum container.

2. A vacuum container as described in claim 1, wherein said vacuum container comprises one or more dispensing devices.

3. A vacuum container as described in claim 1, wherein said dispensing device is a rotary cavity device, or a piston device, or a dual valve device.

4. A vacuum container as described in claim 1 having a separator device disposed within the vacuum container.

5. A vacuum container as described in claim 1 having one or more separator devices disposed within the vacuum container.

6. A vacuum container as described in claim 1, wherein said vacuum container comprises one or more separator devices selected from the group consisting of a stationary screen, a filter, a vibrator screen, a hydrocyclone and a centrifuge.

7. A vacuum container as described in claim 1, 2, 3, 4, 5 or 6, having a separator device disposed within the vacuum container to separate by category the contents vacuumed into the vacuum container before they are dispensed from the vacuum container.

8. A vacuum container as described in claim 1, wherein said vacuum container has a screen separator disposed within the vacuum container to separate said liquid from the solid particles, and a dispensing device to remove the liquid from the vacuum container without eliminating the vacuum environment within the vacuum container.

9. A vacuum container as described in claim 1, wherein said vacuum container has a screen separator disposed within the vacuum container to separate said liquid from the solid particles; a dispensing device to remove the liquid from the vacuum container and a dispensing device to remove solid particles from the vacuum container without eliminating the vacuum environment within the vacuum container.

10. A vacuum container as described in claim 1, 2, 3, 4, 5, 6, 8 or 9, wherein said vacuum container is attached to a mobile platform.

11. A vacuum container as described in claim 1, wherein said vacuum container is attached to a powered mobile vehicle and has a screen separator disposed within the vacuum container to separate said liquids from the solid particles; a dispensing pump removes the liquid from the vacuum container and a rotary screw dispensing device removes solid particles from the vacuum container without eliminating the vacuum environment within the vacuum container.

12. A vacuum container as described in claim 1, 2, 3, 4, 5, 6, 8 or 9, wherein said vacuum container is attached to a powered mobile vehicle.

* * * * *